US008226388B2

(12) United States Patent
Tanaka et al.

(10) Patent No.: US 8,226,388 B2
(45) **Date of Patent: *Jul. 24, 2012**

(54) OIL-COOLED SCREW COMPRESSOR

(75) Inventors: Hideharu Tanaka, Shizuoka (JP); Hiroyuki Matsuda, Yaizu (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 133 days.

This patent is subject to a terminal disclaimer.

(21) Appl. No.: 12/818,271

(22) Filed: Jun. 18, 2010

(65) Prior Publication Data

US 2010/0254836 A1 Oct. 7, 2010

Related U.S. Application Data

(63) Continuation of application No. 12/193,862, filed on Aug. 19, 2008, now Pat. No. 7,762,799, which is a continuation of application No. 11/360,918, filed on Feb. 24, 2006, now Pat. No. 7,473,084.

(30) Foreign Application Priority Data

Sep. 30, 2005 (JP) ..... 2005-285827

(51) Int. Cl.
*F01C 1/18* (2006.01)
*F03C 2/00* (2006.01)
*F03C 4/00* (2006.01)

(52) U.S. Cl. .. 418/201.1; 418/97; 418/270; 418/DIG. 1; 55/400; 55/406

(58) Field of Classification Search ..... 418/84, 418/88, 97, 201.1, 270, DIG. 1; 55/400, 55/406, DIG. 17
See application file for complete search history.

(56) References Cited

U.S. PATENT DOCUMENTS

| | | | |
|---|---|---|---|
| 3,291,385 | A | 12/1966 | Williams |
| 4,420,293 | A | 12/1983 | Hofmann |
| 4,563,138 | A | 1/1986 | Hoffman |
| 4,780,061 | A | 10/1988 | Butterworth |
| 4,983,106 | A | 1/1991 | Wright |
| 5,261,802 | A | 11/1993 | Yanagisawa |
| 6,210,132 | B1 | 4/2001 | Shiinoki |
| 6,488,480 | B1 | 12/2002 | Zhong |
| 6,506,039 | B1 | 1/2003 | Osumimoto et al. |

(Continued)

FOREIGN PATENT DOCUMENTS

JP 54-94057 U 12/1952

(Continued)

OTHER PUBLICATIONS

Office Action of Japanese Appln. No. 2005-285827 with translation.

(Continued)

*Primary Examiner* — Theresa Trieu
(74) *Attorney, Agent, or Firm* — Antonelli, Terry, Stout & Kraus, LLP.

(57) ABSTRACT

In an oil-cooled screw compressor comprising, a compressor body including a pair of a male rotor and a female rotor, a motor including a stator and a motor rotor connected to one of the male and female rotors, and an oil separator container for gathering the oil from a mixture of the gaseous manner and oil to restrain the oil from proceeding with the compressed gaseous matter after the mixture of the gaseous manner and oil is discharged from the pair of male and female rotors, a rotational axis of the motor rotor and the rotational axis of the one of the male and female rotors are coaxial with respect to each other.

14 Claims, 2 Drawing Sheets

U.S. PATENT DOCUMENTS

| | | | |
|---|---|---|---|
| 6,572,350 | B2 | 6/2003 | Takahashi |
| 6,991,443 | B2 | 1/2006 | Aoki et al. |
| 7,014,437 | B2 | 3/2006 | Ohsumimoto et al. |
| 7,473,084 | B2 | 1/2009 | Tanaka |
| 2004/0184941 | A1 | 9/2004 | Aoki et al. |

FOREIGN PATENT DOCUMENTS

| | | | |
|---|---|---|---|
| JP | 02264190 | | 10/1990 |
| JP | 03-134269 | A | 6/1991 |
| JP | 3-107322 | U | 11/1991 |
| JP | 09-287580 | | 11/1997 |
| JP | 2001-214865 | A | 8/2001 |
| JP | 2002-21759 | A | 1/2002 |
| JP | 2002-70778 | A | 3/2002 |
| JP | 2003-42082 | A | 2/2003 |
| JP | 2003-139079 | | 5/2003 |
| JP | 2004-176699 | | 6/2004 |
| JP | 2004176677 | | 6/2004 |
| JP | 2005-061350 | A | 3/2005 |
| JP | 2005-146967 | | 6/2005 |

OTHER PUBLICATIONS

Partial translation of Office Action of Japanese Appln. No. 2005-285827 mailed Jun. 2, 2009.

OIL-COOLED SCREW COMPRESSOR

CROSS-REFERENCE TO RELATED APPLICATION

This application is a continuation application of U.S. application Ser. No. 12/193,862 filed Aug. 19, 2008 now U.S. Pat. No. 7,762,799, which is a continuation application of U.S. application Ser. No. 11/360,918 filed Feb. 24, 2006 now U.S. Pat. No. 7,473,084, the contents of each of which are incorporated herein by reference.

INCORPORATION BY REFERENCE

The present application claims priority from Japanese application JP-A-2005-285827 filed on Sep. 30, 2005, the content of which is hereby incorporated by reference into this application.

BACKGROUND OF THE INVENTION

The present invention relates to an oil-cooled screw compressor having an oil separator container.

A conventional oil-cooled screw compressor having an oil separator container is disclosed by, for example, FIG. 1 of JP-B2-3262011. In this conventional art, a compressor body and the oil separator container are connected by a pipe, and the compressor body is driven by an electric motor through a belt and a pair of transmission pulleys.

Another conventional art is disclosed by JP-A-2004-176699 (FIG. 1), in which a receiver for gathering a lubricant oil, the compressor body and the electric motor are aligned along a substantially straight line.

BRIEF SUMMARY OF THE INVENTION

In JP-B2-3262011, since the compressor body, oil separator container and electric motor are arranged separately and the connecting pipe, transmission pulleys and belt are necessary, a mounting space needs to be great. Further, since the compressor body, oil separator container and electric motor are arranged separately, vibration absorbers for preventing a vibration from being transmitted from the compressor body, oil separator container and electric motor to a base for a compressor unit need to be arranged on the compressor body, oil separator container and electric motor respectively to cause a defect of cost increase.

Further, when the compressor body is driven by the electric motor through the pulleys and belt, an alignment of the pulleys and a tension of the belt need to be adjusted so that a structure for maintaining the adjusted condition, for example, a common base for the compressor body and electric motor needs to be used to cause the cost increase and a great mounting space.

In JP-A-2004-176699, the oil separator container, the compressor body and the electric motor are aligned along the substantially straight line to be integrated, however the following defect occurs.

A first defect is that an axially long shape causes an increase of the mounting space. A purpose of integrating the oil separator container, compressor body and electric motor is to decrease the mounting space, but aligning them along the substantially straight line cannot decrease sufficiently the mounting space.

A second defect is that the axially long shape causes an increase of number of vibration absorbing elements (for example, vibration absorbing rubbers) for effectively absorbing the vibration.

A third defect relates to a maintenance operation. When a bearing arranged at a suction side of the compressor body to support a rotor side of the electric motor is exchanged, the rotor needs to be removed from a compressor body casing by discharging the oil from the oil separator container and separating the compressor body casing from the oil separator container. Further, since the integrated compressor body and so force with the long axial length need to be mounted on, for example, the common base, to position the axes of the motor and the compressor body needed to be repaired below an eye position, a defect of that the maintenance operation is difficult is caused.

An object of the present invention is to provide an oil-cooled screw compressor by which a mounting space and cost thereof is decreased, and a maintenance operation therefore is made easy.

According to the invention, an oil-cooled screw compressor adapted to be cooled by an oil when a gaseous matter is compressed by the oil-cooled screw compressor and adapted to be mounted on a base, comprises, a compressor body including a pair of a male rotor and a female rotor (engaging with each other to define a variable volume therebetween and rotatable with respect to each other to decrease the variable volume so that the gaseous matter is compressed in the variable volume), a motor including a stator and a motor rotor connected to one of the male and female rotors to be rotationally driven (so that the gaseous matter is compressed), a pair of first and second bearings arranged to support in a rotatable manner the one of the male and female rotors at respective sides of the one of the male and female rotors opposite to each other along a rotational axis of the one of the male and female rotors, and an oil separator container for gathering the oil from a mixture of the gaseous manner and oil to restrain the oil from proceeding with the compressed gaseous matter after the mixture of the gaseous manner and oil is discharged from the pair of male and female rotors.

If the oil separator container extends in such a manner that the gathered oil is contained at a region of the oil separator container overlapping at least a part of the pair of male and female rotors as seen in an observing direction perpendicular to the rotational axis, for example, as seen vertically when the oil and gaseous matter are discharged from the pair of male and female rotors, the axial length of the compressor is further decreased to decrease the mounting space for the compressor.

If a rotational axis of the motor rotor and the rotational axis of the one of the male and female rotors are coaxial with respect to each other, so that an axial length of the compressor is decreased to decrease a mounting space for the compressor, the motor rotor has a first end part through which the motor rotor is connected to the one of the male and female rotors, a motor rotor body adapted to cooperate with the stator to generate a force for driving the one of the male and female rotors, and a second end part opposite to the first end part through the motor rotor body along the rotational axis of the one of the male and female rotors, and the second end part is prevented from being supported in a direction perpendicular to the rotational axis of the one of the male and female rotors to have an overhang shape, that is, the second end part is prevented from bearing or receiving a force applied from an outside of the motor rotor to the motor rotor to support the motor rotor in the direction, an axial length of the compressor is decreased to decrease a mounting space for the compressor, and a rigidity of a casing containing therein the motor may be low at a part of the casing surrounding the second end part so that a center of gravity of the compressor can be arranged close to an axially medium position of the axial length of the compressor, whereby an area for fixing the compressor to the base can be close to the axially medium position of the axial length of the compressor to decrease the mounting space for the compressor.

If the motor rotor body includes a permanent magnet, a weight of the motor rotor can be decreased to arrange the center of gravity of the compressor further close to the axially medium position of the axial length of the compressor. It is preferable for stably supporting the motor rotor that the first end part is supported in the direction by one of the first and second bearings, that is, the first end part bears or receives a force applied from the outside of the motor rotor to the motor rotor to support the motor rotor in the direction.

If the second end part is prevented from being supported in another direction parallel to the rotational axis of the one of the male and female rotors to have the overhang shape, that is, the second end part is prevented from bearing or receiving a force applied from the outside of the motor rotor to the motor rotor to support the motor rotor in the another direction, the rigidity of the casing containing therein the motor may be further decreased at the part of the casing surrounding the second end part so that the center of gravity of the compressor can be arranged further close to the axially medium position of the axial length of the compressor.

If a spring constant of a first connection between the compressor and the base through one of sides which are juxtaposed with each other along the rotational axis with a boundary of an imaginary straight line extending perpendicular to the rotational axis as seen in the observing direction and which one of sides overlaps the motor rotor as seen in the observing direction is greater than a spring constant of a second connection between the compressor and the base through the other one of sides which other one of sides is prevented from overlapping the motor rotor as seen in the observing direction, a vertical vibration of the motor having a relatively greater mass and vibration degree in comparison with the pair of the male and female rotors can be effectively and stably supported by the spring constant of the first connection.

It is preferable for effectively and stably supporting the vertical vibration of the motor that the boundary overlaps one of the first and second bearings arranged between the one of the male and female rotors and the motor rotor as seen in the observing direction, or the boundary overlaps a central position of the oil separator container as seen in the observing direction, or the boundary overlaps a screw-shaped portion of the one of the male and female rotors as seen in the observing direction.

If a number of connecting points between the compressor and the base which connecting points are independent of each other on the one of sides is greater than a number of connecting points between the compressor and the base which connecting points are independent of each other on the other one of sides, the spring constant of the first connection is securely greater than the spring constant of the second connection.

Other objects, features and advantages of the invention will become apparent from the following description of the embodiments of the invention taken in conjunction with the accompanying drawings.

DETAILED DESCRIPTION OF THE INVENTION

Embodiments of the invention are described below with making reference to the drawings.

Figure 1:
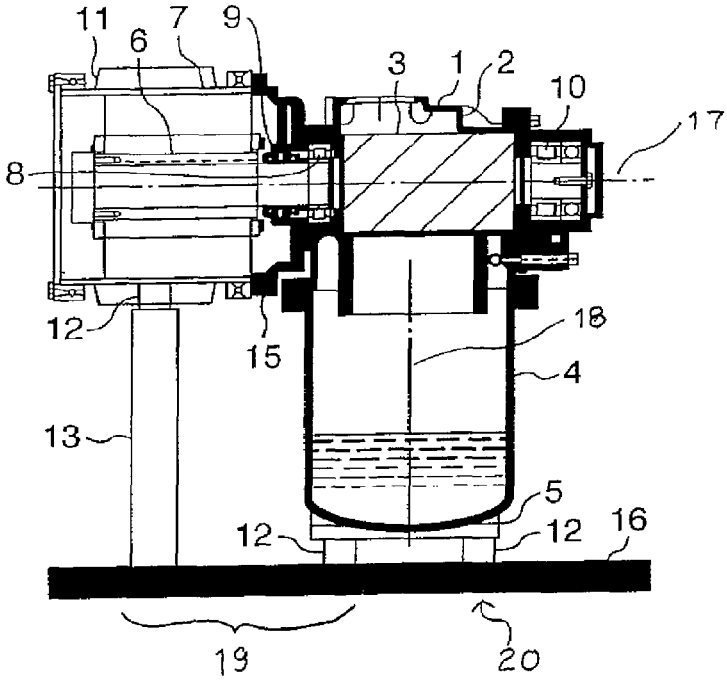
FIG. 1 is a vertically cross sectional view showing a first embodiment of the invention.

FIG. 1 shows a first embodiment of the invention. A compressor body 1 is integrally fixed to an oil separator container 4 having a central axis 18 arranged below a compressor body casing 2. An electric motor 11 is a permanent magnet electric motor (DC brush-less motor or the like) using a permanent magnet for a rotor. A stator 7 of the electric motor 11 is integrally fixed to the compressor body casing 2 through an intermediate casing 15. Further, the compressor body 1 includes a pair of a male rotor and a female rotor. In FIG. 1, one rotor 3, e.g., the male rotor of the male rotor and female rotor of the compressor body 1 can be seen supported by bearings 8 and 10 in the compressor body casing 2. The rotor 6 of the electric motor 11 is connected coaxially to an intake side of the one rotor 3 and is supported by the bearing 8.

A mechanical seal 9 prevents a lubricant for the bearing 8 from proceeding into the electric motor 11. Vibration absorbing rubbers (vibration absorbing elements) 12 are arranged between a leg part 5 under the oil separator container 4 and a mounting base 16 and between the electric motor 11 and a supporting stay 13 on the mounting base 16.

The compressor body 1, oil separator container 4 and electric motor 11 are integrally connected to have a reversed L-shape (or T-shape) so that the rotor 6 of the electric motor 11 has an overhang structure, a connecting pipe, belt, pulleys, electric motor bearing and so forth can be eliminated to decrease a size of the compressor. Further, an axial length can be decreased be easily contained by a cabinet or frame so that the size of a compressor unit is decreased.

Further, since the electric motor 11 is arranged above the oil separator container 4, attaching and removing the electric motor 11 can be performed efficiently. Further, when the bearing 8 for supporting the rotor 6 with the permanent magnet is exchanged, the compressor body 1 and oil separator container 4 do not need to be separated from each other.

Figure 2:
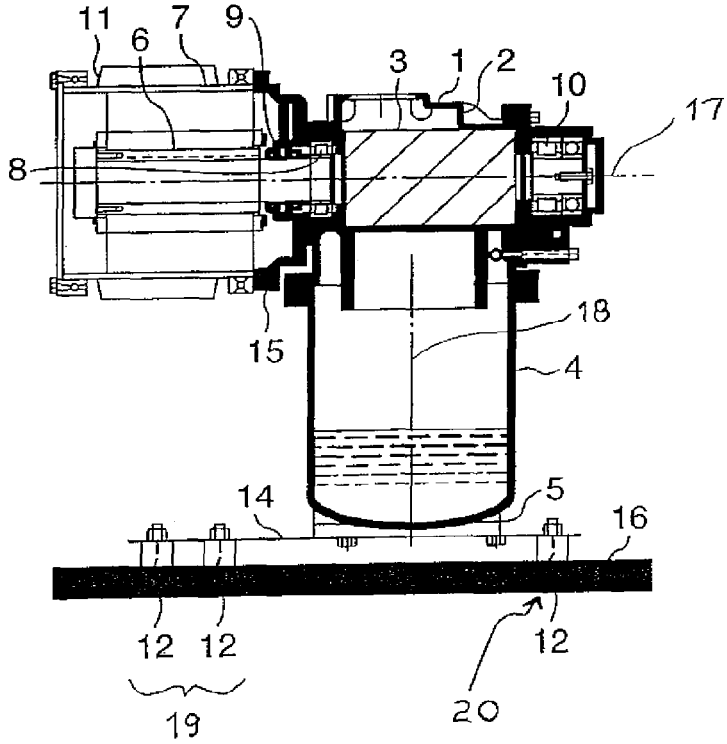
FIG. 2 is a vertically cross sectional view showing a second embodiment of the invention.
Figure 3:
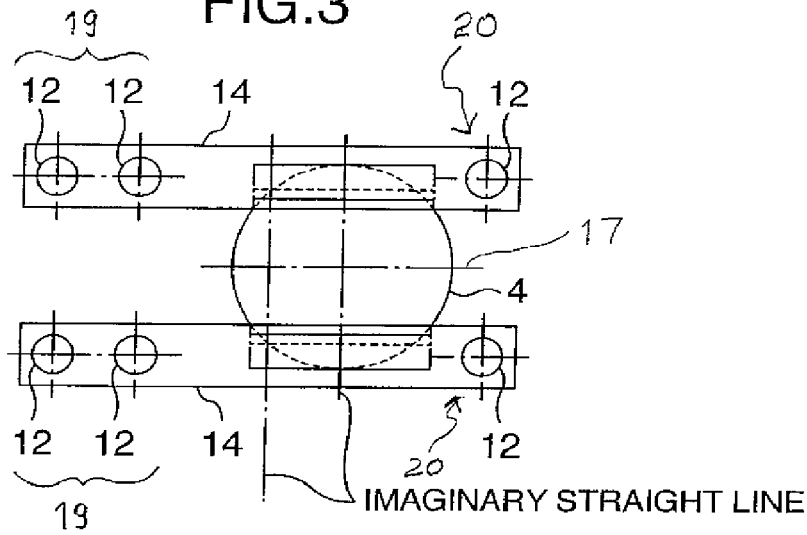
FIG. 3 is a bottom view of the second embodiment.

A second embodiment is shown in FIGS. 2 and 3. In this embodiment, a rail 14 is arranged under the oil separator container 4, the leg part 5 of the oil separator container is fixed to the rail 14, and the rail 14 is connected to the base 16 through vibration absorbing rubbers 12 so that the integrated compressor body 1, electric motor 11 and oil separator container 4 are mounted.

Since a center of gravity of the integrated compressor body 1, electric motor 11 and oil separator container 4 is made close to the electric motor 11, four of the vibration absorbing rubbers 12 are arranged at a side area of the rail 14 close to the electric motor 11 and two of the vibration absorbing rubbers 12 are arranged at the other side area thereof away from the electric motor 11 as shown in FIGS. 2 and 3 so that a central axis 18 of the oil separator container 4 is kept vertical. The other structure is similar to that of FIG. 1.

In this embodiment, the supporting stay 13 shown in FIG. 1 is eliminated to use its space effectively so that the size of the compressor unit can be further decreased.

Figure 4:
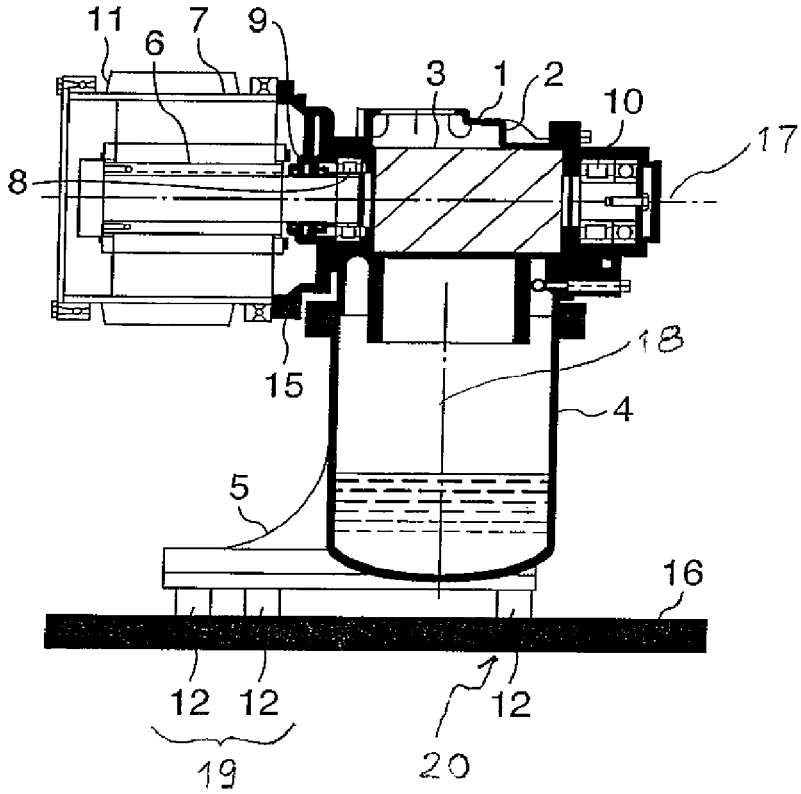
FIG. 4 is a vertically cross sectional view showing a third embodiment of the invention.

A third embodiment is shown in FIG. 4. In this embodiment, the leg part 5 under the oil separator container 4 is elongated to a position away from the center of gravity of the integrated electric motor 11 and oil separator container 4 toward the electric motor 11. Therefore, the rail 14 as shown in FIG. 2 can be eliminated to decrease a number of elements and the cost. The other structure is similar to those of FIGS. 1 and 2.

According to the present invention, a spring constant of a first connection 19 (having connecting points formed by the vibration absorbing elements 12) between the compressor and the base 16 through one of sides which sides are juxtaposed with each other along the rotational axis 17 with a boundary of an imaginary straight line (see, FIG. 3) extending perpendicular to the rotational axis 17 as seen in an observing direction perpendicular to the rotational axis 17 and which one of sides overlaps the motor rotor 6 as seen in the observing direction is greater than a spring constant of a second connection 20 (having connecting points formed by the vibration absorbing elements 12) between the compressor and the base 16 through the other one of sides. As shown by the left-most "imaginary straight line" in FIG. 3, the boundary can overlap the bearings 8 arranged between the one of the male and female rotors 3 and the motor rotor 6 as seen in the observing direction. As shown by the right-most "imaginary straight line" in FIG. 3, the boundary can overlap a screw-shaped portion of the one of the male and female rotors 3 as seen in the observing direction; more particularly, the boundary can overlap a central position of the oil separator 4 container as seen in the observing direction.

A number of connecting points (formed by the vibration absorbing elements 12) between the compressor and the base 16 which connecting points are independent of each other on the one of sides is greater than a number of connecting points (formed by the vibration absorbing elements 12) between the compressor and the base which connecting points are independent of each other on the other one of sides.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A screw compressor adapted to be cooled by a coolant when a gaseous matter is compressed by the screw compressor and adapted to be mounted on a base, comprising, a compressor body including a pair of a male rotor and a female rotor, a motor including a stator and a motor rotor connected to one of the male and female rotors to be rotationally driven, a pair of first and second bearings arranged to support in a rotatable manner the one of the male and female rotors at respective sides of the one of the male and female rotors opposite to each other along a rotational axis of the one of the male and female rotors, a coolant separator container for gathering the coolant from a mixture of the gaseous matter and coolant to restrain the coolant from proceeding with the compressed gaseous matter after the mixture of the gaseous matter and coolant is discharged from the pair of male and female rotors, and a connection adapted to be provided between the coolant separator container and the base so that the motor is supported through the coolant separator container, wherein the connection between the coolant separator container and the base comprises a leg part of the coolant separator container connected to a plurality of rails, the plurality of rails extending beyond the coolant separator container toward a position under the electric motor, wherein a rotational axis of the motor rotor and the rotational axis of the one of the male and female rotors are coaxial with respect to each other, the motor rotor has a first end part through which the motor rotor is connected to the one of the male and female rotors, a motor rotor body adapted to cooperate with the stator to generate a force for driving the one of the male and female rotors, and a second end part opposite to the first end part through the motor rotor body along the rotational axis of the one of the male and female rotors, and the second end part is prevented from bearing or receiving a force applied from an outside of the motor rotor to the motor rotor to support the motor rotor, wherein the coolant separator container extends in such a manner that the gathered coolant is contained at a region of the coolant separator container overlapping at least a part of the pair of male and female rotors as seen in an observing direction perpendicular to the rotational axis, wherein a center of gravity of the screw compressor is arranged on an axial side of a central position of the coolant separator container on which the motor is arranged, and wherein the compressor body, the motor and the coolant separator container form one of a reversed L-shape and a T-shape.

2. The screw compressor according to claim 1, wherein an entire length of the pair of the male rotor and the female rotor extending in a direction parallel to the rotational axis is within an outer periphery of the coolant separator container.

3. The screw compress& according to claim 1, wherein the motor rotor body includes a permanent magnet.

4. The screw compressor according to claim 1, wherein the first end part is supported in the direction by one of the first and second bearings.

5. The screw compressor according to claim 1, wherein the second end part is prevented from being supported in another direction parallel to the rotational axis of the one of the male and female rotors.

6. The screw compressor according to claim 1, wherein a spring constant of a first connection between the compressor and the base through one of sides which sides are juxtaposed with each other along the rotational axis with a boundary of an imaginary straight line extending perpendicular to the rotational axis as seen in an observing direction perpendicular to the rotational axis and which one of sides overlaps the motor rotor as seen in the observing direction is greater than a spring constant of a second connection between the compressor and the base through the other one of sides, and wherein the boundary overlaps one of the first and second bearings arranged between the one of the male and female rotors and the motor rotor as seen in the observing direction.

7. The screw compressor according to claim 6, wherein the boundary overlaps a central position of the coolant separator container as seen in the observing direction.

8. The screw compressor according to claim 1, wherein a spring constant of a first connection between the compressor and the base through one of sides which sides are juxtaposed with each other along the rotational axis with a boundary of an imaginary straight line extending perpendicular to the rotational axis as seen in an observing direction perpendicular to the rotational axis and which one of sides overlaps the motor rotor as seen in the observing direction is greater than a spring constant of a second connection between the compressor and the base through the other one of sides, and wherein the boundary overlaps a screw-shaped portion of the one of the male and female rotors as seen in the observing direction.

9. The screw compressor according to claim 1, wherein the screw compressor has a first connection between the motor and the base and a second connection between the coolant separator container and the base, and the first and second connections are independent from each other.

10. The screw compressor according to claim 1, wherein the leg part of the coolant separator container is connected to the base through vibration absorbing elements.

11. The screw compressor according to claim 1, wherein the plurality of rails are connected to the base through vibration absorbing elements.

12. The screw compressor according to claim 1, wherein the leg part of the coolant separator container is provided under the coolant separator container.

13. The screw compressor according to claim 12, wherein the leg part of the coolant separator container is provided entirely under the coolant separator container.

14. A screw compressor adapted to be cooled by a coolant when a gaseous matter is compressed by the screw compressor and adapted to be mounted on a base, comprising, a compressor body including a pair of a male rotor and a female rotor, a motor including a stator and a motor rotor connected to one of the male and female rotors to be rotationally driven, a pair of first and second bearings arranged to support in a rotatable manner the one of the male and female rotors at respective sides of the one of the male and female rotors opposite to each other a rotational axis of the one of the male and female rotors, a coolant separator container for gathering the coolant from a mixture of the gaseous matter and coolant to restrain the coolant from proceeding with the compressed gaseous matter after the mixture of the gaseous matter and coolant is discharged from the pair of male and female rotors, and a connection adapted to be provided between the coolant separator container and the base so that the motor is supported through the coolant separator container, wherein the connection between the coolant separator container and the base comprises a leg part of the coolant separator container and the leg part of the coolant separator container extends beyond the oil separator container toward a position under the electric motor, wherein a rotational axis of the motor rotor and the rotational axis of the one of the male and female rotors are coaxial with respect to each other, the motor rotor has a first end part through which the motor rotor is connected to the one of the male and female rotors, a motor rotor body adapted to cooperate with the stator to generate a force for driving the one of the male and female rotors, and a second end part opposite to the first end part through the motor rotor body along the rotational axis of the one of the male and female rotors, and the second end part is prevented from bearing or receiving a force applied from an outside of the motor rotor to the motor rotor to support the motor rotor, wherein the coolant separator container extends in such a manner that the gathered coolant is contained at a region of the coolant separator container overlapping at least a part of the pair of male and female rotors as seen in an observing direction perpendicular to the rotational axis, wherein a center of gravity of the screw compressor is arranged on an axial side of a central position of the coolant separator container on which the motor is arranged, and wherein the compressor body, the motor and the coolant separator container form one of a reversed L-shape and a T-shape.

* * * * *